US005915694A

United States Patent [19]

Brum

[11] Patent Number: 5,915,694

[45] Date of Patent: Jun. 29, 1999

[54] DECOY UTILIZING INFRARED SPECIAL MATERIAL

[76] Inventor: Roger D. Brum, 15 Barcelona, Irvine, Calif. 92614

[21] Appl. No.: 09/005,290

[22] Filed: Jan. 9, 1998

[51] Int. Cl.[6] ..... F42B 5/15; F42B 5/145; H01Q 15/00

[52] U.S. Cl. ..... 273/359; 102/505; 102/503; 102/501; 102/502; 273/363; 273/362; 342/12

[58] Field of Search ..... 434/15, 14; 273/362, 273/360, 359, 363; 102/504, 505, 350, 503; 342/12

[56] References Cited

U.S. PATENT DOCUMENTS

| | | | |
|---|---|---|---|
| 2,381,130 | 8/1945 | Lloyd | 102/32 |
| 2,448,343 | 8/1948 | Zandmer | 102/92.5 |
| 2,551,596 | 5/1951 | Haglund | 175/183 |
| 2,813,719 | 11/1957 | Hopper | 273/105.3 |
| 2,907,536 | 10/1959 | Von Zborowski | 244/12 |
| 2,923,549 | 2/1960 | Hopper et al. | 273/105.3 |
| 2,953,377 | 9/1960 | Brust | 273/105.3 |
| 2,998,754 | 9/1961 | Bialy | 89/1.7 |
| 3,002,708 | 10/1961 | Wetzel et al. | 244/3 |
| 3,135,511 | 6/1964 | Norman et al. | 273/105.3 |
| 3,225,655 | 12/1965 | Inglis | 89/1.7 |
| 3,410,559 | 11/1968 | Miller | 273/360 |
| 3,505,926 | 4/1970 | Johnson | 89/1 |
| 3,610,096 | 10/1971 | Bauman et al. | 89/1.808 |
| 3,720,167 | 3/1973 | Mainhardt et al. | 102/34.4 |
| 3,808,941 | 5/1974 | Biggs | 89/1.5 R |
| 3,871,321 | 3/1975 | Giebel et al. | 114/221 A |
| 3,898,661 | 8/1975 | Kelly et al. | 343/18 |
| 3,899,975 | 8/1975 | Lawrence | 102/63 |
| 3,932,057 | 1/1976 | Wadensten | 415/53 |
| 4,062,112 | 12/1977 | Lake | 30/228 |
| 4,140,433 | 2/1979 | Eckel | 415/2 |
| 4,195,571 | 4/1980 | Beeker et al. | 102/89 |
| 4,205,848 | 6/1980 | Smith et al. | 273/361 |
| 4,406,227 | 9/1983 | Beeker et al. | 102/505 |
| 4,428,583 | 1/1984 | Feagle | 273/348.1 |
| 4,446,793 | 5/1984 | Gibbs | 102/505 |
| 4,607,849 | 8/1986 | Smith et al. | 273/348.1 |
| 4,718,320 | 1/1988 | Brum | 89/1.11 |
| 4,770,368 | 9/1988 | Yates et al. | 244/1 TD |
| 4,796,536 | 1/1989 | Yu et al. | 102/505 |
| 4,852,455 | 8/1989 | Brum | 89/1.14 |
| 4,860,657 | 8/1989 | Steiniche et al. | 102/334 |
| 4,899,662 | 2/1990 | Santalucia et al. | 102/505 |
| 5,074,216 | 12/1991 | Dunne et al. | 102/334 |
| 5,179,778 | 1/1993 | Dickson et al. | 29/876 |
| 5,249,924 | 10/1993 | Brum | 416/48 |
| 5,445,078 | 8/1995 | Marion | 102/505 |
| 5,499,582 | 3/1996 | Schiessl et al. | 102/334 |

FOREIGN PATENT DOCUMENTS

| | | | |
|---|---|---|---|
| 1336769 | 7/1963 | France | 244/1 TD |
| 1229397 | 11/1966 | Germany . | |

OTHER PUBLICATIONS

"Defense Electronics", vol. 18, No. 10, Oct. 1986.

*Primary Examiner*—Jessica J. Harrison
*Assistant Examiner*—David A. Fleming
*Attorney, Agent, or Firm*—Stetina Brunda Garred & Brucker

[57] ABSTRACT

An aerial decoy comprising a fuselage having forward and aft ends. Disposed within the fuselage are a plurality of decoy discs. Rotatably connected to the forward end of the fuselage is a ram air turbine which is cooperatively engaged to the decoy discs such that the rotation of the ram air turbine facilitates the dispensation of the decoy discs from the aft end of the fuselage.

9 Claims, 3 Drawing Sheets

Fig. 6
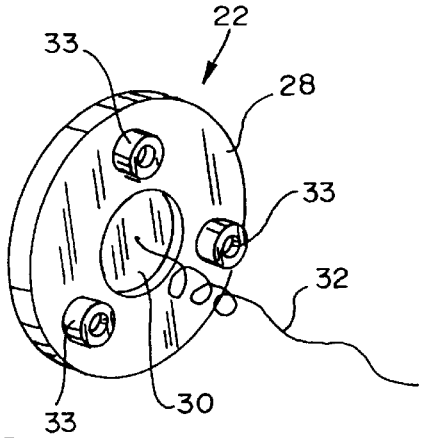
Fig. 7
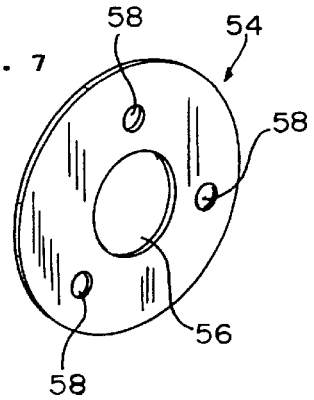
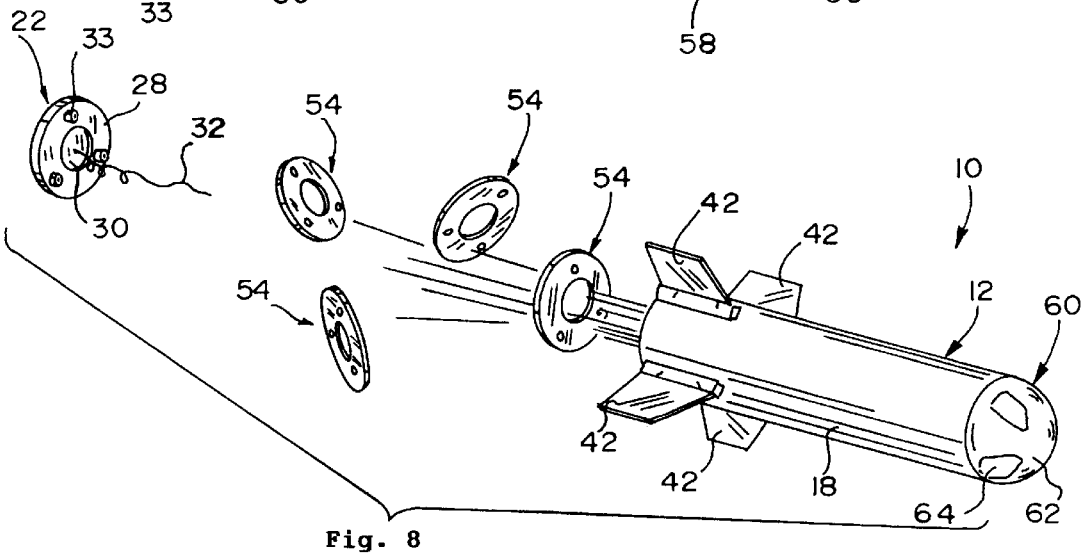
Fig. 8
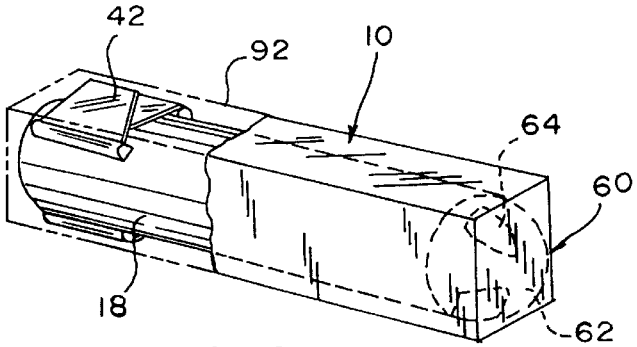
Fig. 9

DECOY UTILIZING INFRARED SPECIAL MATERIAL

FIELD OF THE INVENTION

The present invention relates generally to expendable decoys, and more particularly to an advanced aerial expendable decoy which is self propelled and adapted to create an infrared signature which moves at a velocity and trajectory commensurate to that of the aircraft from which the decoy is deployed.

BACKGROUND OF THE INVENTION

As is well known in the prior art, military aircraft are typically provided with decoys which are used to draw various types of guided weapons away from the aircraft. One of the most commonly used decoy devices is a flare which is adapted to attract infrared or heat seeking guided missiles away from the deploying aircraft. In this respect, the flare is designed to present a larger thermal target than the aircraft from which it is deployed, thus attracting the weapon away from the aircraft.

Over recent years, flares have become decreasingly effective as decoy devices due to anti-aircraft weaponry having become more sophisticated and provided with enhanced capabilities to discriminate between flares and the deploying aircraft. In this respect, modern heat seeking missiles are typically provided with both a frequency discriminator which is adapted to sense the intensity of the infrared signature of the aircraft and a kinetic discriminator which is adapted to sense the speed and trajectory at which the infrared signature is traveling. When a conventional flare is deployed from the aircraft, the infrared signature produced thereby is typically more intense in the near visible frequency range than that produced by the engines of the aircraft, with the velocity and trajectory of the flare being significantly different than that of the deploying aircraft since the flare, once deployed, slows rapidly and falls straight toward the ground. The frequency discriminator of the guided missile is adapted to distinguish between the infrared signature produced by the flare and that produced by the engines of the aircraft. Additionally, the kinetic discriminator of the guided missile is adapted to distinguish between the velocity and trajectory of the aircraft and that of the flare, even if the frequency discriminator does not distinguish the infrared signatures produced thereby. As such, the combined functionality of the frequency and kinetic discriminators of the guided missile typically succeeds in causing the guided missile to disregard the deployed flare, and continue to target the aircraft.

In view of the above-described shortcomings of conventional flares, there exists a need in the art for a decoy which, when deployed from the aircraft, is adapted to create an infrared signature which is similar in magnitude or intensity to that produced by the aircraft engines, and travels at a velocity and trajectory commensurate to that of the aircraft so as to defeat the targeting capabilities of the frequency and kinetic discriminators of modern heat seeking missiles. It is also important that such decoy be retrofittable into existing deployment systems on the aircraft. The present invention, as will be described in more detail below, addresses this need in the art.

SUMMARY OF THE INVENTION

In accordance with the present invention, there is provided an aerial decoy which comprises a fuselage having forward and aft ends. The fuselage itself comprises an elongate, tubular body which has a generally cylindrical configuration. Attached to one end of the body is a forward bulkhead, while attached to the opposite end of the body is an aft bulkhead. Additionally, attached to the forward bulkhead is a nose cone which defines the forward end of the fuselage. The fuselage further comprises a plurality of collapsible fins which are attached to the body in close proximity to the aft bulkhead.

The aerial decoy of the present invention further comprises a plurality of decoy discs which are disposed within the fuselage, and more particularly within the body thereof. Each of the decoy discs preferably has an annular configuration, and comprises a thin sheet of iron foil provided with a surface treatment which causes the extremely rapid oxidation thereof when exposed to air. The decoy discs are disposed in stacked relation to each other, and are effectively sealed within the body by the forward and aft bulkheads so as not to be exposed to air.

In addition to the fuselage and the decoy discs, the aerial decoy of the present invention comprises a ram air turbine which is rotatably connected to the forward end of the fuselage and cooperatively engaged to the decoy discs in a manner wherein the rotation of the ram air turbine facilitates the dispensation of the decoy discs from the aft end of the fuselage. In the preferred embodiment, the ram air turbine is cooperatively engaged to the decoy discs via a deployment assembly which comprises at least one, and preferably three, elongate deployment rods which are rotatably connected to the fuselage, and in particular the forward bulkhead. The deployment assembly further comprises a piston which itself has an annular configuration and is cooperatively engaged to the deployment rods in a manner wherein the rotation of the deployment rods facilitates the movement (i.e., axial or longitudinal travel) of the piston toward the aft end of the fuselage. In addition to the deployment rods and the piston, the deployment assembly includes a gear reduction unit which mechanically couples the ram air turbine to the deployment rods in a manner wherein the rotation of the ram air turbine at a first rotational speed facilitates the concurrent rotation of the deployment rods at a second rotational speed which is substantially less than the first rotational speed.

In the aerial decoy of the present invention, the deployment rods are also cooperatively engaged to the aft bulkhead of the fuselage such that a prescribed number of revolutions of the ram air turbine will facilitate the detachment of the aft bulkhead from the deployment rods and the body of the fuselage. Such detachment opens the aft end of the fuselage which facilitates the dispensation of the decoy discs therefrom as the piston moves toward the aft end.

In the preferred embodiment, the ram air turbine of the aerial decoy comprises a nose impeller which is removably attached to the forward end of the fuselage. The nose impeller includes a partially splined input shaft extending therefrom which is cooperatively engaged to the gear reduction unit of the deployment assembly.

The decoy of the present invention further comprises a rocket motor which is removably mounted within the body of the fuselage and is cooperatively engaged to the aft bulkhead via a pull wire such that the detachment of the aft bulkhead from the deployment rods and the body facilitates the ignition of the rocket motor. Since the aft bulkhead is not detached from the deployment rods and the body until such time as the ram air turbine has undergone the prescribed number of revolutions, the rocket motor is prevented from igniting until the ram air turbine is rotated by the direct impingement of an air stream thereagainst. Accordingly, inadvertant ignition of the rocket motor during the loading of the aerial decoy of the present invention into an aircraft is substantially prevented.

BRIEF DESCRIPTION OF THE DRAWINGS

These, as well as other features of the present invention, will become more apparent upon reference to the drawings wherein:

FIG. 6 is a perspective view of the aft bulkhead of the fuselage of the aerial decoy;

FIG. 7 is a perspective view of a decoy disc of the aerial decoy;

FIG. 8 is a perspective view illustrating the manner in which the aft bulkhead is detached from the fuselage and the decoy discs dispensed from the aft end thereof; and FIG. 9 is a partial cut-away view illustrating the manner in which the aerial decoy of the present invention is stored within a decoy canister of an aircraft.

DETAILED DESCRIPTION OF THE PREFERRED EMBODIMENT

Figure 2:
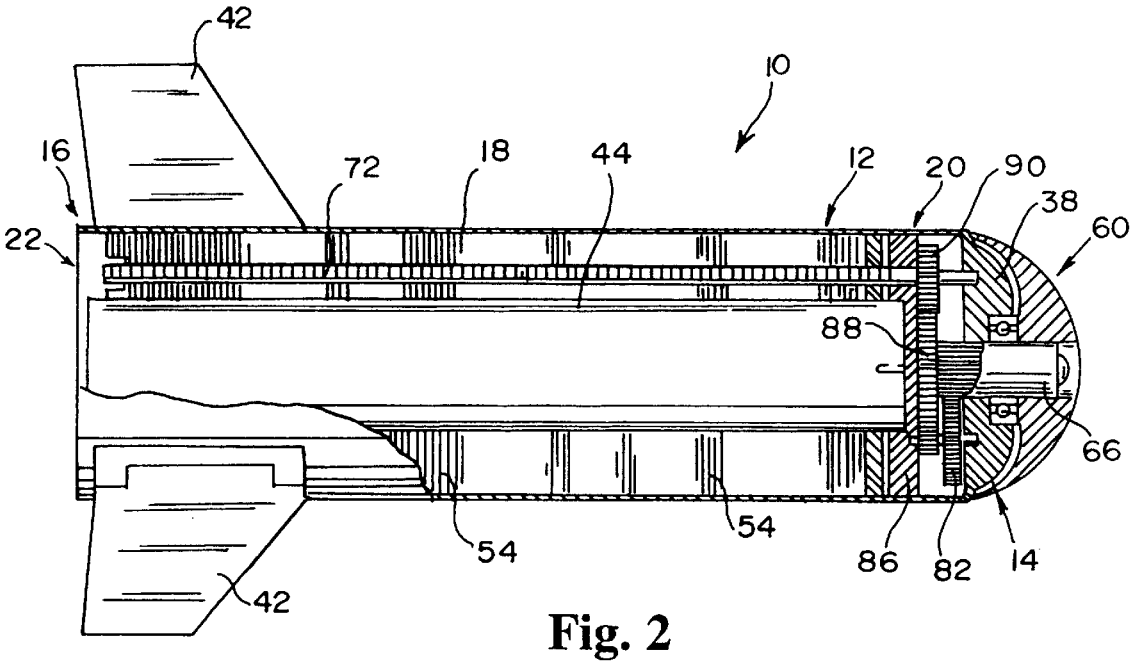
FIG. 2 is a cross-sectional view of the aerial decoy of the present invention.
Figure 4:
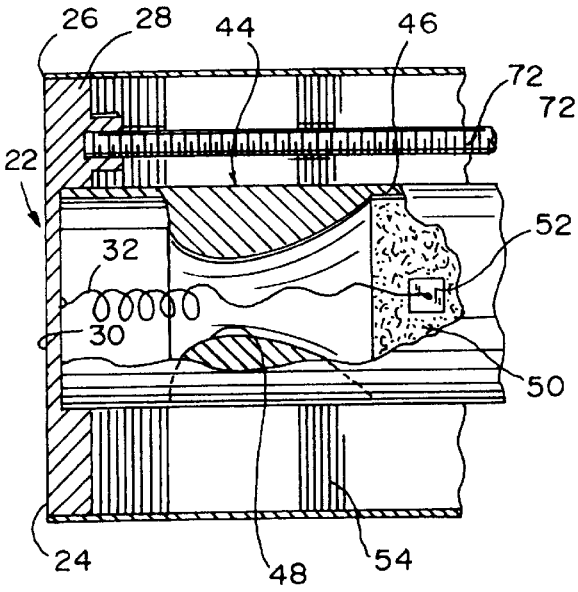
FIG. 4 is a partial cross-sectional view of the aft portion of the aerial decoy of the present invention, illustrating the manner in which the rocket motor of the aerial decoy is cooperatively engaged to the aft bulkhead of the fuselage thereof.
Figure 5:
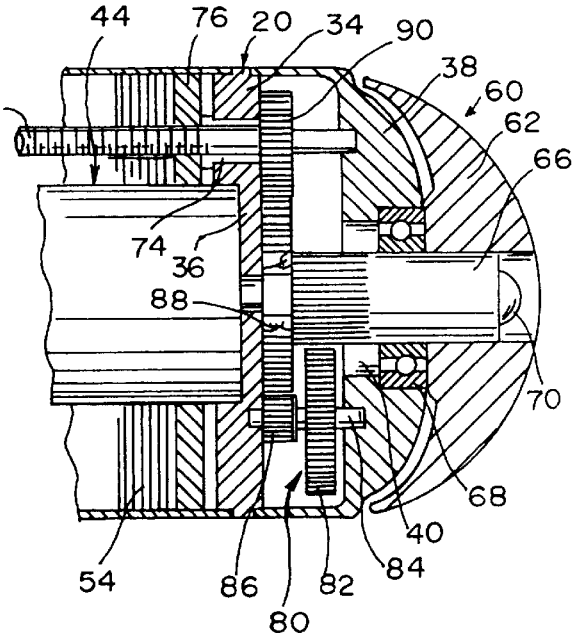
FIG. 5 is a partial cross-sectional view of the forward portion of the aerial decoy of the present invention, illustrating the cooperative engagement of the ram air turbine thereof to the decoy discs via the deployment assembly.

Referring now to the drawings wherein the showings are for purposes of illustrating a preferred embodiment of the present invention only, and not for purposes of limiting the same, FIG. 2 provides a cross-sectional view of an aerial decoy 10 constructed in accordance with the present invention. As seen in FIGS. 2, 4 and 5, the aerial decoy 10 comprises a fuselage 12 which defines a forward end 14 and an aft end 16. The fuselage 12 itself comprises an elongate, tubular body 18 which has a generally cylindrical configuration. Attached to one end of the body 18 is a forward bulkhead 20 which partially resides within the interior of the body 18 and protrudes forwardly therefrom.

Referring now to FIGS. 2, 4 and 6, attached to that end of the body 18 opposite that including the forward bulkhead 20 is an aft bulkhead 22 which fully resides within the interior of the body 18 such that the outer surface 24 of the aft bulkhead 22 is substantially flush with the rim 26 of the body 18 which defines the aft end 16 of the fuselage 12. The aft bulkhead 22 includes a peripheral portion 28 and an integral end cap portion 30 which is of reduced thickness. Formed on the inner surface of peripheral portion 28 of the aft bulkhead 22 are three (3) cylindrically configured, internally threaded bosses 33. The bosses 33 are preferably oriented about the end cap portion 30 in equidistantly spaced intervals of approximately 120 degrees. Attached to the approximate center of the inner surface of the end cap portion 30 is one end of an elongate pull wire 32. The uses of the pull wire 32 and bosses 33 will be described in more detail below. The aft bulkhead 22 is selectively detachable from the remainder of the aerial decoy 10 for reasons which will also be described in more detail below.

Similar to the aft bulkhead 22, the forward bulkhead 20 includes a peripheral portion 34, and a central portion 36 which is of reduced thickness. Rigidly attached to the peripheral portion 34 of the forward bulkhead 20 is a nose cone 38 which defines the forward end 14 of the fuselage 12 and includes a central opening 40 extending axially therethrough. As previously indicated, the aft end 16 of the fuselage 12 is defined by the rim 26 of the body 18. In addition to the above-described components, the fuselage 12 includes four (4) collapsible stabilizer fins 42 which are pivotally connected to the body 18 in relative close proximity to the rim 26 thereof. As seen in FIG. 8, the fins 42 are preferably oriented in equidistantly spaced relation to each other, i.e., intervals of approximately 90 degrees.

As best seen in FIGS. 4 and 5, disposed within the interior of the body 18 of the fuselage 12 is a rocket motor 44. The rocket motor 44 comprises a hollow, cylindrically configured housing or canister 46 which defines a reduced diameter nozzle region 48. When the aerial decoy 10 is assembled, one end of the canister 46 is abutted against the inner surface of the central portion 36 of the forward bulkhead 20, with the opposite end of the canister 46 being abutted against the inner surface of the end cap portion 30 of the aft bulkhead 22. Disposed within the interior of the canister 46 forwardly of the nozzle region 48 thereof is a quantity of solid rocket propellent 50. As seen in FIG. 4, the end of the pull wire 32 opposite the end attached to the center of the inner surface of the end cap portion 30 of the aft bulkhead 22 is attached to an ignitor 52 inserted into the rocket propellent 50. As will be discussed in more detail below, the detachment of the pull wire 32 from the ignitor 52 facilitates the ignition of the rocket propellent 50, and hence the rocket motor 44. In the preferred embodiment, the rocket motor 44 is removably mounted within the interior of the body 18. Such removable mounting allows the aerial decoy 10 to be retrofitted with differing rocket motors depending upon the desired velocity of the aerial decoy 10 when the rocket motor is ignited.

Referring now to FIGS. 2–5 and 7, the aerial decoy 10 of the present invention further comprises a multiplicity of decoy discs 54 which are disposed within the interior of the body 18 of the fuselage 12. As best seen in FIG. 7, each of the decoy discs 54 has a generally annular configuration, and includes a circularly configured central opening 56 disposed therein. The central opening 56 is sized such that the diameter thereof slightly exceeds the outer diameter of the canister 46 of the rocket motor 44. Also disposed within each decoy disc 54 are three (3) circularly configured apertures 58 which are oriented about the central opening 56 in equidistantly spaced intervals of approximately 120 degrees. In the preferred embodiment, each decoy disc 54 comprises a thin sheet of iron foil, both sides of which are coated with a surface treatment (commonly referred to as Infrared Special Material) which causes the extremely rapid oxidation of the iron foil in air. In this respect, the oxidation occurs at a rate which causes the decoy discs, when exposed to air, to glow a dull red and give off a significant amount of heat, therefore providing a substantial infrared signature.

In the aerial decoy 10, the decoy discs 54 are disposed within the interior of the body 18 in stacked relation to each other. The aligned central openings 56 of the decoy discs 54 accommodate the canister 46 of the rocket motor 44, with the decoy discs 54 extending thereabout. The decoy discs 54 extend between the inner surfaces of the annular piston 76 and the peripheral portion 28 of the aft bulkhead 22, and are oriented such that the apertures 58 define three (3) coaxially aligned sets. As seen in FIG. 4, the decoy discs 54 and aft bulkhead 22 are formed such that each set of the coaxially aligned apertures 58 is itself coaxially aligned with a respective one of the bosses 33 of the aft bulkhead 22.

Referring now to FIGS. 2, 5 and 8, rotatably connected to the forward end 14 of the fuselage 12, and in particular to the nose cone 38, is a ram air turbine 60 (RAT). The ram air turbine 60 comprises a nose impeller 62 which includes a plurality of impeller blades 64 extending from the outer surface thereof. Rigidly attached to the nose impeller 62 and extending axially therefrom is an input shaft 66. The aft portion of the outer surface of the input shaft 66 is splined. The ram air turbine 60 is rotatably connected to the nose cone 38 by the extension of the input shaft 66 through a bearing 68 disposed within the central opening 40 of the nose cone 38. The advancement of the input shaft 66 through the bearing 68 is limited by the abutment of the nose impeller 62 against the bearing 68. When such abutment occurs, the bearing 68 circumvents the non-splined portion of the outer surface of the input shaft 66, with the splined portion thereof protruding axially from the back of the central opening 40 toward the forward bulkhead 20.

The rotatable connection of the ram air turbine 60 to the nose cone 38 is maintained by an impeller retaining fastener 70 which is axially advanced through the input shaft 66 and engaged to the central portion 36 of the forward bulkhead 20. The ram air turbine 60 may be quickly and easily replaced with an alternative ram air turbine simply by detaching the fastener 70 from the forward bulkhead 20 and removing the same from within the input shaft 66. As will also be described in more detail below, the ram air turbine 60 of the aerial decoy 10 is cooperatively engaged to the decoy discs 54 in a manner wherein the rotation of the ram air turbine 60 facilitates the dispensation of the decoy discs 54 from the aft end 16 of the fuselage 12 one at a time.

Figure 3:
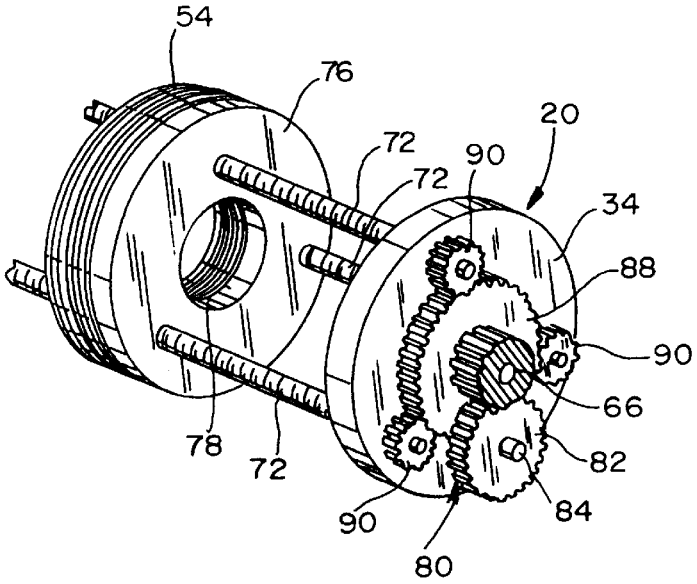
FIG. 3 is a partial perspective view of the deployment assembly and decoy discs of the aerial decoy of the present invention.

Referring now to FIGS. 2, 3 and 5, the cooperative engagement of the ram air turbine 60 to the decoy discs 54 is facilitated by a deployment assembly which comprises three (3) elongate, externally threaded deployment rods 72. Each of the deployment rods 72 extends through a respective set of the coaxially aligned apertures 58 of the decoy discs 54, with the back or aft ends of each of the deployment rods 72 being threadably received into a respective one of the internally threaded bosses 33 of the aft bulkhead 22. As best seen in FIG. 5, the frontal or forward end of each deployment rod 72 is defined by a reduced diameter section thereof which is separated from the remainder of the deployment rod 72 by an annular shoulder. The forward ends of the deployment rods 72 are rotatably supported by the nose cone 38, with the deployment rods being extended through and rotatably supported by respective ones of three (3) bearing members 74 disposed within the peripheral portion 34 of the forward bulkhead 20.

Each of the bearing members 74 includes a flange portion which extends radially outward from one end thereof and is abutted against the inner surface of the peripheral portion 34 of the forward bulkhead 20, with the opposite end of the bearing member 74 being substantially flush with the outer surface of the peripheral portion 34. Each deployment rod 72 is oriented within a respective bearing member 74 such that the shoulder defined by the deployment rod 72 is substantially flush with that end of the bearing member 74 which is itself flush with the outer surface of the peripheral portion 34 of the forward bulkhead 20. As will be recognized, each of the deployment rods 72 extends in generally parallel relation to the axis of the body 18 of the fuselage 12.

In addition to the deployment rods 72, the deployment assembly comprises an annular piston 76 which is cooperatively engaged to the deployment rods 72. The piston 76 has a configuration which is virtually identical to that of the decoy discs 54, and includes a central opening 78 having a diameter identical to that of the central opening 56 of each decoy disc 54. In addition to the central opening 78, the piston 76 includes three (3) internally threaded apertures disposed therein. The location of the piston apertures relative to the central opening 76 is the same as the location of the apertures 58 of each decoy disc 54 relative to the central opening 56 thereof. As seen in FIGS. 3–5, though the piston 76 and decoy discs 54 are of substantially identical outer diameter, the thickness of the piston 76 substantially exceeds that of each decoy disc 54.

The internally threaded apertures of the piston 76 are coaxially aligned with respective ones of the coaxially aligned sets of apertures 58 of the decoy discs 54, with the cooperative engagement of the piston 76 to the deployment rods 72 being facilitated by the threadable receipt of the deployment rods 72 into respective ones of the internally threaded apertures of the piston 76. As will be recognized, due to the threadable engagement of the deployment rods 72 to the piston 76, the concurrent rotation of the deployment rods 72 in a common direction will facilitate the movement or axial travel of the piston 76 therealong. As will be described in more detail below, in the aerial decoy 10, the deployment rods 72 are simultaneously rotated so as to facilitate the longitudinal movement of the piston 76 toward the aft end 16 of the fuselage 12.

Referring now to FIGS. 2, 3 and 5, in the aerial decoy 10, the movement of the piston 76 rearwardly along the deployment rods 72 (i.e., the concurrent rotation of the deployment rods 72) is facilitated by the rotation of the ram air turbine 60. In this respect, the deployment assembly of the aerial decoy 10 further comprises a gear reduction unit 80 which mechanically couples the ram air turbine 60 to the deployment rods 72 in a manner wherein the rotation of the ram air turbine 60 at a first rotational speed facilitates the rotation of the deployment rods 72 at a second rotational speed which is substantially less than the first rotational speed. The gear reduction unit 80 comprises a first gear 82 which is cooperatively engaged to the splined outer surface portion of the input shaft 66 of the ram air turbine 60. The first gear 82 is supported on a rotatable shaft 84 which extends between and is rotatably connected to the nose cone 38 and peripheral portion 34 of the forward bulkhead 20. The gear reduction unit 80 further comprises a second gear 86 which is also supported upon the shaft 84 and is cooperatively engaged to a third gear 88 rotatably connected to the central portion 36 of the forward bulkhead 20. The third gear 88 of the gear reduction unit 80 is not connected to the input shaft 66 of the ram air turbine 60.

In addition to the first, second and third gears 82, 86, 88, the gear reduction unit 80 includes three (3) identically configured planetary gears 90 which are attached to respective ones of the reduced diameter sections of the deployment rods 72 and are cooperatively engaged to the third gear 88. Each planetary gear 90 is preferably advanced over the reduced diameter section of a respective deployment rod 72 until such time as it comes into abutting contact with the shoulder defined by the deployment rod 72. As will be recognized, due to the configuration of the gear reduction unit 80 and the relative sizes of the gears 82, 86, 88, 90 thereof, the rotation of the ram air turbine 60 at an extremely high rotational speed will facilitate the concurrent rotation of the deployment rods 72 at substantially reduced rotational speeds. As previously indicated, such simultaneous rotation of the deployment rods 72 facilitates the movement of the piston 76 therealong toward the aft end 16 of the fuselage 12.

Having thus described the structural attributes of the aerial decoy 10, the use and operation thereof will now be described with reference to FIGS. 1, 8 and 9. The aerial decoy 10 is preferably stored within an existing, conventional decoy canister 92 of an aircraft 94. Importantly, the aerial decoy 10 is specifically sized and configured to be insertable into the canister 92 with which many aircraft are already outfitted, thus eliminating the need to retrofit the aircraft with a differently configured decoy canister to accommodate the aerial decoy 10. The insertion of the aerial decoy 10 into the decoy canister 92 is accomplished by collapsing the fins 42 in the manner shown in FIG. 9.

Figure 1:
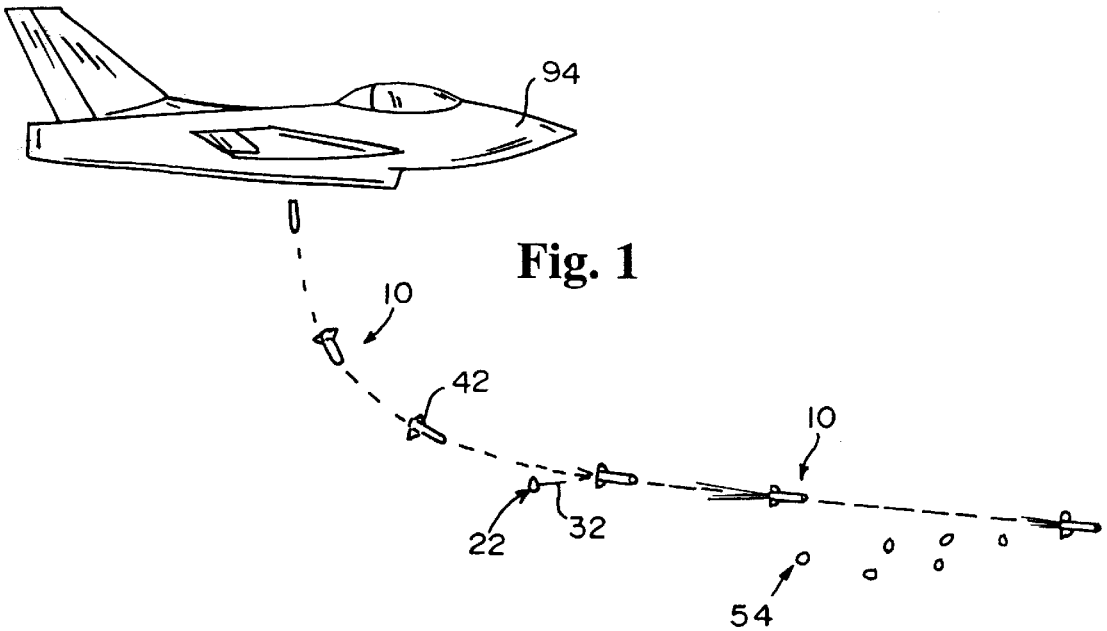
FIG. 1 is a side view illustrating the manner in which the aerial decoy of the present invention is deployed from an aircraft.

As seen in FIG. 1, the aerial decoy 10, when initially deployed from the aircraft 94, initially falls in a substantially vertical trajectory. Immediately after deployment from the decoy canister 92, the fins 42 spring to their normal, fully extended positions. Importantly, the aerial decoy 10 is specifically configured such that the extension of the fins 42 will result in a shift in the trajectory of the aerial decoy 10 from a substantially vertical trajectory to a substantially horizontal trajectory as also shown in FIG. 1.

As the trajectory of the aerial decoy 10 shifts in the above-described manner upon its deployment from the decoy canister 92 of the aircraft 94, the impingement of the air stream against the impeller blades 64 of the ram air turbine 60 initiates the rotation thereof. Such rotation of the ram air turbine 60 in turn results in the concurrent rotation of the deployment rods 72. Due to the threadable engagement of the deployment rods 72 to the aft bulkhead 22, the rotation of the deployment rods 72 forces the aft bulkhead 22 out of the body 18, with the aft bulkhead 22 eventually becoming completely disconnected from the deployment rods 72. As will be recognized, the forcing aft of the aft bulkhead 22 from within the body 18 and the eventual disconnection thereof from the deployment rods 72 will only occur after the ram air turbine 60 has completed a prescribed number of revolutions.

Immediately upon the detachment of the aft bulkhead 22 from the body 18 and deployment rods 72, the force of the air stream against the aft bulkhead 22 rips it away from the remainder of the aerial decoy 10 which results in the disconnection of the pull wire 32 from the ignitor 52, and hence the ignition of the rocket propellent 50 of the rocket motor 44. As seen in FIGS. 1 and 8, the ignition of the rocket motor 44 thrusts the aerial decoy 10 along its generally horizontal trajectory, with the resultant impingement of the high speed air stream against the impeller blades 64 of the ram air turbine 60 facilitating the continued and increased rotational speed thereof. This rotation of the ram air turbine 60, and hence the deployment rods 72, causes the piston 76 to move along the deployment rods 72 toward the aft end 16 and effectively push the decoy discs 54 therefrom in succession.

As the decoy discs 54 are exposed to air, their surface treatment causes them to rapidly oxidize and produce a significant infrared signature. Because the decoy discs 54 are dispensed in succession from the rocket propelled aerial decoy 10, the infrared signature produced by the aerial decoy 10 is of an intensity and moves at a velocity and trajectory commensurate with that of the aircraft 94. Though not supported by the aft bulkhead 22 subsequent to the ejection thereof from the aerial decoy 10, the deployment rods 72 continue to be supported along their longitudinal lengths by the decoy discs 54 and the piston 76 as it moves toward the aft end 16. The dispensation of all the decoy discs 54 from within the body 18 occurs at approximately the same time the rocket propellent 50 of the rocket motor 44 is completely exhausted. It will be recognized that when the aerial decoy 10 is assembled, the interior of the body 18 defined between the forward and aft bulkheads 20, 22 in which the decoy discs 54 are stored is substantially air-tight, thus preventing any premature oxidation of the decoy discs 54.

Since the rocket motor 44 is not ignited until such time as the aerial decoy 10 assumes a generally horizontal trajectory, the decoy discs 54 can be positively retained within the body 18 during the initial violent pitch oscillations of the aerial decoy 10 upon its deployment from the aircraft 94. In this respect, in the aerial decoy 10, the ignition of the rocket motor 44 is delayed until after such initial pitch oscillations have been damped. Additionally, since a prescribed number of revolutions of the ram air turbine 60 must be completed to facilitate the ejection of the aft bulkhead 22 and hence the ignition of the rocket motor 44, an accidental ejection of the aerial decoy 10 when the aircraft 94 is on the ground will not result in the ignition of the rocket motor 44 or the dispensation of the decoy discs 54 from the body 18. In this respect, the accidental ejection of the aerial decoy 10 when the aircraft 94 is on the ground does not result in any rotation of the ram air turbine 60 due to the lack of an impinging air stream being exerted thereagainst.

In the aerial decoy 10, the dispensation rate of the decoy discs 54 from the body 18 per flight path distance is almost a constant. In this respect, the faster the air speed of the aerial decoy 10, the faster the dispensation rate of decoy discs 54 therefrom. Due to the rocket motor 44 being removably mounted within the body 18 and the ram air turbine 60 being removably attached to the nose cone 38, these particular components can be easily changed for high/low speed applications.

Additional modifications and improvements of the present invention may also be apparent to those of ordinary skill in the art. Thus, the particular combination of parts described and illustrated herein is intended to represent only one embodiment of the present invention, and is not intended to serve as limitations of alternative devices within the spirit and scope of the invention.

What is claimed is:

1. An aerial decoy, comprising:

a fuselage having forward and aft ends;

a plurality of decoy discs disposed within the fuselage; and a ram air turbine rotatably connected to the forward end of the fuselage and cooperatively engaged to the decoy discs in a manner wherein the rotation of the ram air turbine facilitates the dispensation of the decoy discs from the aft end of the fuselage.

2. The aerial decoy of claim 1 wherein said ram air turbine is cooperatively engaged to the decoy discs via a deployment assembly comprising:

at least one elongate deployment rod rotatably connected to the fuselage;

a piston cooperatively engaged to the deployment rod in a manner wherein the rotation of the deployment rod facilitates the movement of the piston toward the aft end of the fuselage; and a gear reduction unit mechanically coupling the ram air turbine to the deployment rod in a manner wherein the rotation of the ram air turbine at a first rotational speed facilitates the rotation of the deployment rod at a second rotational speed which is less than the first rotational speed;

the movement of the piston toward the aft end of the fuselage facilitating the dispensation of the decoy discs therefrom.

3. The aerial decoy of claim 2 wherein said ram air turbine comprises a nose impeller having an input shaft extending therefrom which is cooperatively engaged to the gear reduction unit of the deployment assembly.

4. The aerial decoy of claim 3 wherein the nose impeller is removably attached to the forward end of the fuselage.

5. The aerial decoy of claim 2 wherein the fuselage comprises:

an elongate, generally cylindrical body having said decoy discs disposed there within;

a forward bulkhead attached to the body;

a nose cone attached to the forward bulkhead and having said ram air turbine rotatably connected thereto; and an aft bulkhead attached to the body;

said deployment rod being cooperatively engaged to the aft bulkhead such that a prescribed number of revolutions of the ram air turbine will facilitate the detachment of the aft bulkhead from the deployment rod and the body.

6. The aerial decoy of claim 5 further comprising a rocket motor disposed within the body and cooperatively engaged to the aft bulkhead in a manner wherein the detachment of the aft bulkhead from the deployment rod and the body facilitates the ignition of the rocket motor.

7. The aerial decoy of claim 6 wherein the rocket motor is removably mounted within the body.

8. The aerial decoy of claim 2 wherein said fuselage further comprises a plurality of collapsible fins attached to the body.

9. The aerial decoy of claim 1 wherein each of said decoy discs has an annular configuration and comprises a thin sheet of iron foil provided with a surface treatment which causes the extremely rapid oxidation thereof in air.

* * * * *